US009731919B2

(12) United States Patent
Saito

(10) Patent No.: US 9,731,919 B2
(45) Date of Patent: Aug. 15, 2017

(54) SHEET CONVEYING APPARATUS AND IMAGE FORMING APPARATUS

(75) Inventor: Hiroshi Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 13/442,063

(22) Filed: Apr. 9, 2012

(65) Prior Publication Data

US 2012/0267848 A1 Oct. 25, 2012

(30) Foreign Application Priority Data

Apr. 22, 2011 (JP) ..... 2011-095658

(51) Int. Cl.
*B65H 7/02* (2006.01)
*B65H 7/14* (2006.01)
*B65H 5/06* (2006.01)

(52) U.S. Cl.
CPC ..... *B65H 7/14* (2013.01); *B65H 5/062* (2013.01); *B65H 2404/6111* (2013.01); *B65H 2553/414* (2013.01); *B65H 2553/46* (2013.01)

(58) Field of Classification Search
CPC ... B65H 7/02; B65H 7/04; B65H 7/14; B65H 2511/51; B65H 2553/414
USPC ..... 271/227, 228; 358/488, 498; 250/559.01, 559.04, 559.11, 559.12, 250/559.13, 559.16, 559.17, 559.29, 250/559.4
See application file for complete search history.

(56) References Cited

U.S. PATENT DOCUMENTS 5,225,689 A * 7/1993 Buckle et al. ..... 250/559.4
RE34,749 E * 10/1994 Leong et al. ..... 250/237 G
5,369,284 A * 11/1994 Bellio ..... 250/559.36
5,391,891 A * 2/1995 Wiegleb ..... B60S 1/0822 250/227.25
5,580,042 A 12/1996 Taniguro et al.
6,168,270 B1 1/2001 Saikawa et al.
6,804,474 B2 10/2004 Morita et al.
6,995,358 B2 * 2/2006 Sano ..... 250/239
8,152,167 B2 4/2012 Saito et al.
2003/0025090 A1 * 2/2003 Iwasaki ..... B65H 7/14 250/559.12
2007/0051884 A1 * 3/2007 Romanov et al. ..... 250/231.13
(Continued)

FOREIGN PATENT DOCUMENTS

JP 62-171562 10/1987
JP 4-234028 * 8/1992
JP 05-346626 A 12/1993
(Continued)

OTHER PUBLICATIONS

Machine translation of Detailed Description section of JP2004-75368.*

*Primary Examiner* — Thomas Morrison
(74) *Attorney, Agent, or Firm* — Fitzpatrick, Cella, Harper & Scinto

(57) ABSTRACT

A sheet conveying apparatus includes a curved sheet conveyance path through which a sheet passes, and a sensor that is disposed in the sheet conveyance path and detects the passing sheet. The sensor includes a light-emitting portion that collects light from a light source and irradiates the passing sheet in an irradiating range which is broader in a sheet conveyance direction than a width direction, and a light-receiving portion that receives the light arriving at and reflected from the sheet.

22 Claims, 9 Drawing Sheets

(56) References Cited

U.S. PATENT DOCUMENTS

| | | | | |
|---|---|---|---|---|
| 2010/0065762 | A1* | 3/2010 | Dror | 250/559.12 |
| 2010/0134552 | A1 | 6/2010 | Suzuki et al. | |

FOREIGN PATENT DOCUMENTS

| | | | | |
|---|---|---|---|---|
| JP | 07-209079 | A | | 8/1995 |
| JP | 2000-202998 | A | | 7/2000 |
| JP | 3261744 | B2 | | 3/2002 |
| JP | 2002-168697 | A | | 6/2002 |
| JP | 2003-040490 | | | 2/2003 |
| JP | 2004-75368 | | * | 3/2004 |
| JP | 2004-107054 | A | | 4/2004 |
| JP | 3548551 | | | 7/2004 |
| JP | 3723006 | B2 | | 12/2005 |
| JP | 2008-266015 | A | | 11/2008 |

* cited by examiner

SHEET CONVEYING APPARATUS AND IMAGE FORMING APPARATUS

BACKGROUND OF THE INVENTION

Field of the Invention

The present invention relates to a sheet conveying apparatus and an image forming apparatus, and more particularly, to the configuration of a sensor that detects a sheet passing through a curved sheet conveyance path.

Description of the Related Art

In recent years, there has been a demand for high speed and high accuracy of an image forming operation and an image reading operation in image forming apparatuses such as copying machines, printers, or facsimiles and image reading apparatuses such as scanners. Accordingly, there is a demand for high speed and high accuracy in sheet conveying apparatuses that are installed in the image forming apparatuses and the image reading apparatuses and convey a sheet such as a recording medium or a document.

The related sheet conveying apparatuses include a sheet conveyance path through which a sheet passes and a number of sensors detecting that the sheet passes is installed along the sheet conveyance path. As the sensors, transmissive optical sensors have been used which include a light source irradiating a sheet with light, light-receiving elements arranged in the light source, and a prism disposed at a position facing the light-receiving elements (see Japanese Patent Laid-Open No. 2003-040490).

In the transmissive sensors, the light-receiving elements detect light reflected from the prism when no sheet is present between the prism and the light-receiving elements. However, the light-receiving elements do not detect the light because the light is blocked when a sheet is present. Therefore, it is possible to detect whether a sheet is present depending on whether the light-receiving elements detect the light reflected from the prism. However, the transmissive sensors, which utilize the configuration in which the sheet blocks the light, may not detect the sheet in a case where the sheet is a sheet such as an OHP sheet through which the light passes.

On the other hand, as other optical sensors, there are reflective sensors which include a light source and light-receiving elements arranged in the light source and in which the light source irradiates a sheet passing through a sheet conveyance path with light and the light-receiving elements receive the light arriving at and reflected from the sheet. The irradiation light is regularly reflected from an OHP sheet or the like. Accordingly, with the above-configured reflective sensors, the OHP sheet or the like which may not be detected with the transmissive sensors can be detected.

However, some related sheet conveying apparatuses include a curved sheet conveyance path. When a transmissive sensor is disposed along such a curved sheet conveyance path and a sheet passes through the sheet conveyance path, the sheet is conveyed in a state where the sheet is angled with respect to the irradiation light from the light source. Here, in the case of the reflective sensors, the irradiation light does not vertically arrive at the conveyed sheet. Therefore, particularly, in a sheet such as the OHP sheet for which irregular reflection is small, the light-receiving element may rarely detect the light reflected from the sheet, as illustrated in FIG. 2B described below.

Accordingly, to easily detect the OHP sheet that has been angled with respect to the light, for example, it is necessary to diffuse the irradiation light or increase the illuminance. However, when the irradiation light is diffused or the illuminance is increased, the light does not arrive at the sheet but a passage member forming the sheet conveyance path so as to be reflected from the passage member. Therefore, there is a concern that the light-receiving element may detect the reflected light so as to cause erroneous detection.

Accordingly, to prevent such erroneous detection, that is, to reliably detect the sheet, for example, it is necessary to provide an escape hole in a portion of the passage member at which the diffused light arrives. However, if the escape hole is provided, there is a concern that a sheet may be jammed in the escape hole at the time of conveying the sheet at high speed.

Accordingly, the invention is devised in the light of the above-mentioned circumstance and is directed to provide a sheet conveying apparatus and an image forming apparatus capable of reliably detecting a sheet being conveyed at high speed along a curved sheet conveyance path.

SUMMARY OF THE INVENTION

The present invention is a sheet conveying apparatus including: a curved sheet conveyance path through which a sheet passes; and a sensor that is disposed in the sheet conveyance path and detects the passing sheet, wherein the sensor includes: a light-emitting portion that collects light from a light source and irradiates the passing sheet in an irradiating range which is broader in a sheet conveyance direction than a width direction; and a light-receiving portion that receives light arriving at and reflected from the sheet.

According to the aspects of the invention, it is possible to reliably detect the sheet being conveyed at high speed along the curved sheet conveyance path by irradiating the sheet with the light from light-emitting portion expanded in the sheet conveyance direction and orienting the light reflected from the sheet toward the light-receiving portion.

Further features of the present invention will become apparent from the following description of exemplary embodiments with reference to the attached drawings.

DESCRIPTION OF THE EMBODIMENTS

Figure 1:
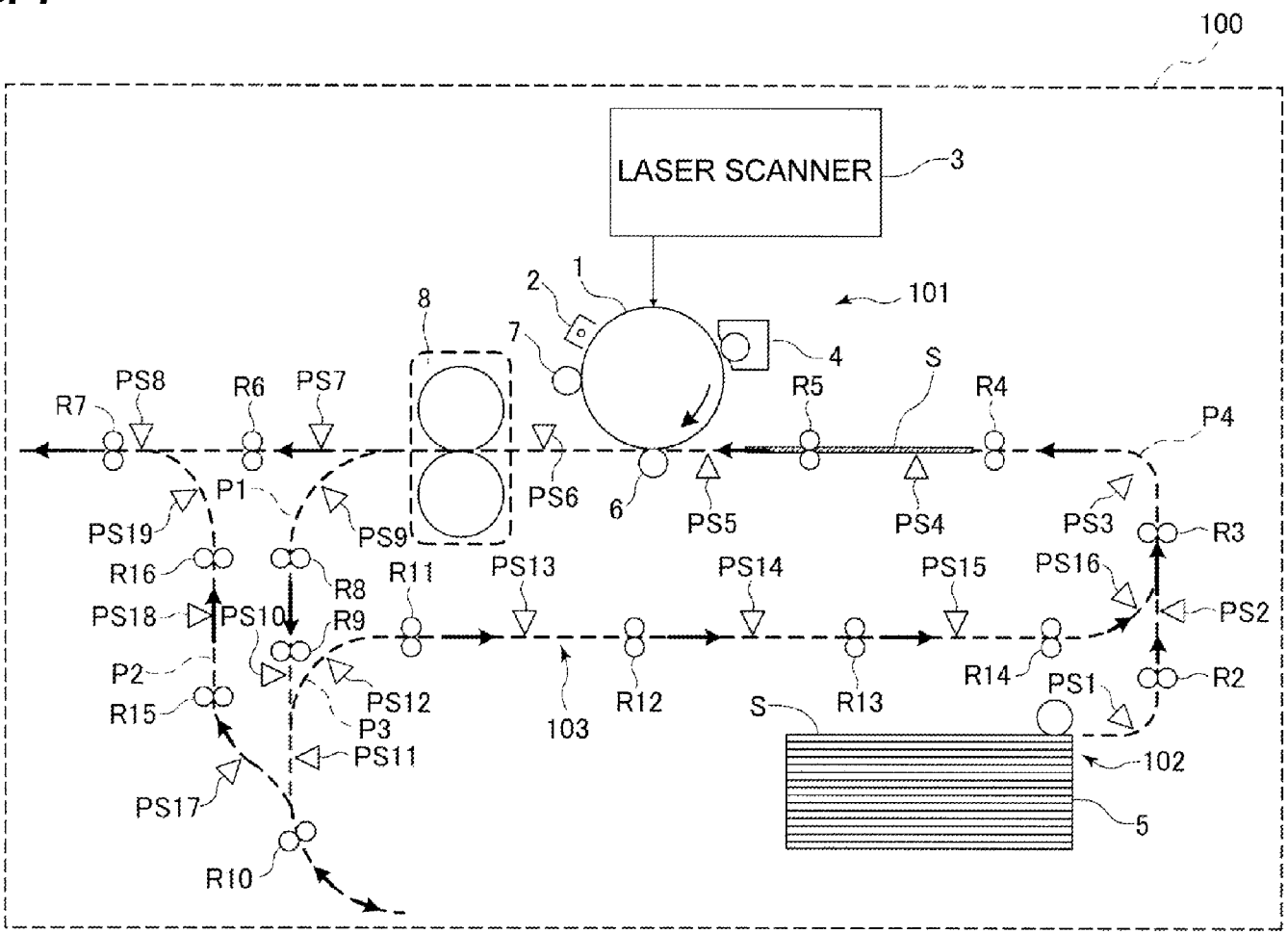
FIG. 1 is a diagram illustrating the overall configuration of an image forming apparatus including a sheet conveying apparatus according to a first embodiment of the invention.

Hereinafter, embodiments of the invention will be described in detail with reference to the drawings. FIG. 1 is a diagram illustrating the overall configuration of an image forming apparatus including a sheet conveying apparatus according to a first embodiment of the invention. FIG. 1 illustrates an image forming apparatus 100, an image forming portion 101 that forms an image on a sheet in accordance with an electrophotographic system, and a sheet feeding portion 102. Here, the image forming portion 101 includes a photosensitive drum 1, a development device 4, and a laser scanner 3. Further, the sheet feeding portion 102 includes a cassette 5 that accommodates a sheet S and a feeding roller R1 that feeds a sheet accommodated in the cassette 5.

Next, an operation of the image forming apparatus 100 with the above-described configuration will be described. When a control device (not illustrated) inputs an image signal into the laser scanner 3, the laser scanner 3 irradiates the photosensitive drum 1 with a laser beam corresponding to the image signal, as indicated by an arrow. At this time, when the photosensitive drum 1 charged in advance is irradiated with the laser beam, an electrostatic latent image is formed. Then, the development device 4 develops the electrostatic latent image, so that a toner image is formed on the photosensitive drum 1.

On the other hand, when the control device outputs a feeding signal to the sheet feeding portion 102, the sheet S is fed from the cassette 5 by the feeding roller R1. Thereafter, at a predetermined timing, the fed sheet S is sent to the photosensitive drum 1 and a transfer portion configured by a transfer charger 6. Next, the toner image is transferred to the sheet S sent to the transfer portion in the transfer portion, and the sheet S is conveyed to a fixing portion 8. Thereafter, when the fixing portion 8 performs heating and pressurizing, the unfixed transferred image is permanently fixed on the sheet S. The sheet S on which the image is fixed is discharged by conveying rollers R6 and discharging rollers 7.

The imaging forming apparatus 100 according to this embodiment has a duplex image forming function and a reverse discharging function. In a reverse discharging mode, the sheet S passing through the fixing portion 8 is switched by a switch member (not illustrated) and is guided toward a divergent passing P1. Next, the sheet S is conveyed from the conveying rollers R8 and R9 to reversing rollers R10, the sheet S is sent to a reverse discharging passage P2 through turnover of the reversing rollers R10 and switch of the switch member, and then the sheet S is conveyed from the conveying rollers R15 and R16 to the discharging roller R7.

In a duplex mode in which images are formed on both sides of a sheet, the sheet S subjected to the fixing operation of the first surface by the fixing portion 8 is first guided toward the divergent passage P1. Next, the sheet S is conveyed to a duplex passage P3 by the turnover of the reversing rollers R10 and the switch of the switch member. Thereafter, the sheet S is conveyed by conveying rollers R11 to R14 installed along the duplex passage P3, a toner image is again transferred to and fixed on the sheet S, and then the sheet S is discharged by the conveying rollers R6 and the discharging rollers R7.

In FIG. 1, a sheet conveying apparatus 103 conveys the sheet. The sheet conveying apparatus 103 includes not only the above-described conveying rollers R6 and R8 to R16 but also conveying rollers R2 to R5 conveying the sheet S fed by the feeding roller R1 to the transfer portion. The sheet conveying apparatus 103 includes not only the above-described divergent passage P1, the reverse discharging passage P2, and the duplex passage P3 but also a sheet conveyance passage formed by a conveyance passage P4 or the like along which the sheet S fed by the feeding roller R1 is conveyed to the transfer portion.

Figure 2A:
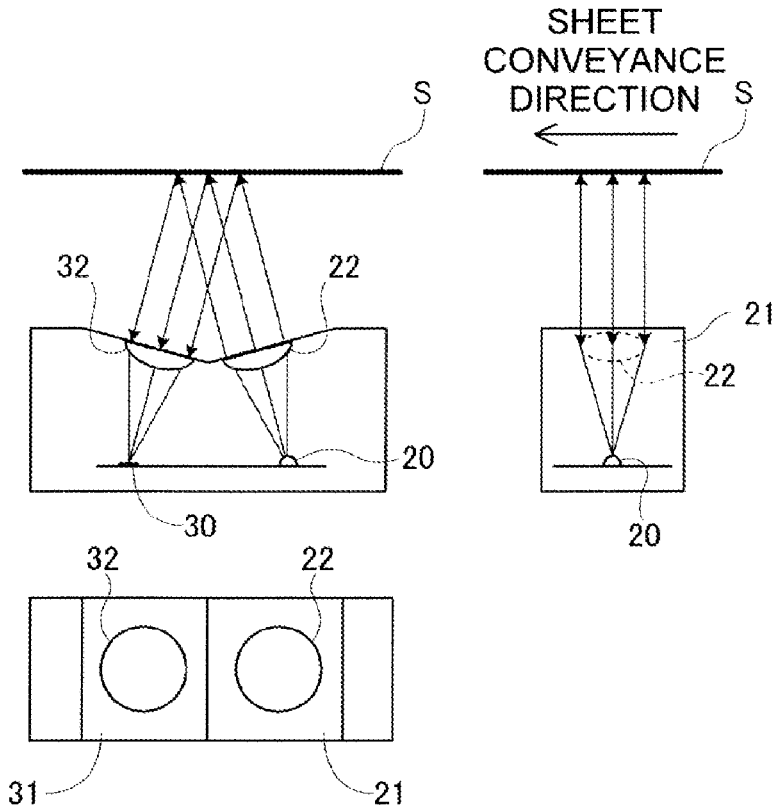
FIGS. 2A and 2B are diagrams illustrating an example of the configuration of a photosensor disposed in the sheet conveying apparatus.
Figure 2B:
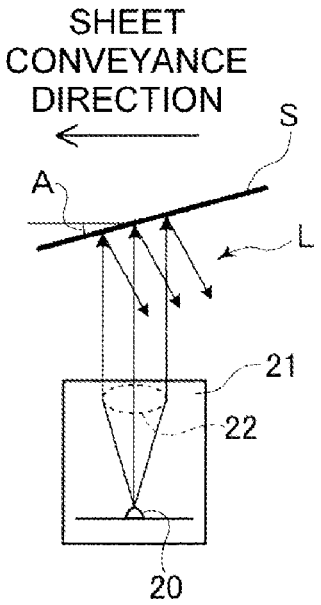

Photosensors PS1 to PS19, which are reflective optical sensors, are disposed along the sheet conveyance path. A controller (not illustrated) detects a pass timing of the sheet S based on signals from the photosensors PS1 to PS19 and performs sheet conveying control. It is detected whether the sheet is jammed based on the signals from the photosensors PS1 to PS19. The signals from the photosensors PS1 to PS19 are also used to determine a timing of an operation of temporarily stopping the sheet or a timing at which a conveyance speed is increased. Here, as the photosensors PS1 to PS19, sensors are used which include a light-emitting portion 21 including an LED 20 serving as a light source and a light-receiving portion 31 including a light-receiving element 30, as illustrated in FIGS. 2A and 2B.

The light-emitting portion 21 further includes a circular light-emitting lens 22 that condense light from the LED 20 and irradiates the sheet S with the light. The light-receiving portion 31 further includes a circular light-receiving lens 32 that condenses the irradiation light from the light-emitting portion 21 and then reflected from the sheet S and orients the light toward the light-receiving element 30.

In the photosensor PS with the above-described configuration, the light from the LED 20 is condensed by the light-emitting lens 22 and the sheet S is irradiated with the light. Thereafter, the sheet can be detected in such a manner that the light-receiving lens 32 condenses the light arriving at and reflected from the sheet S and the light-receiving element 30 receives the light.

Figure 3A:
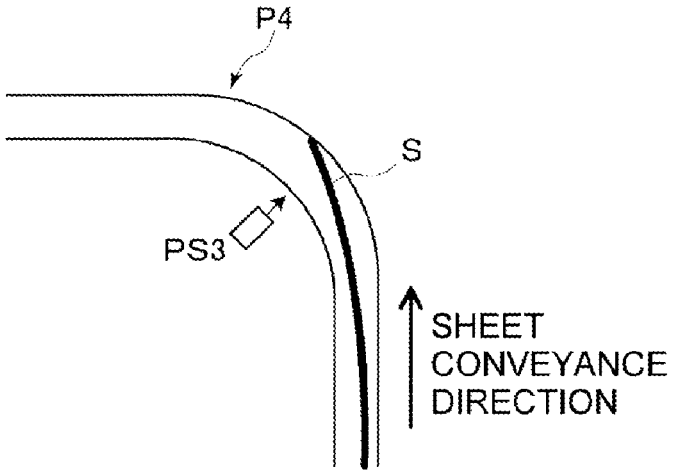
FIGS. 3A to 3C are diagrams illustrating a case where a sheet passes through along a curved sheet conveyance path installed in the sheet conveying apparatus.
Figure 3B:
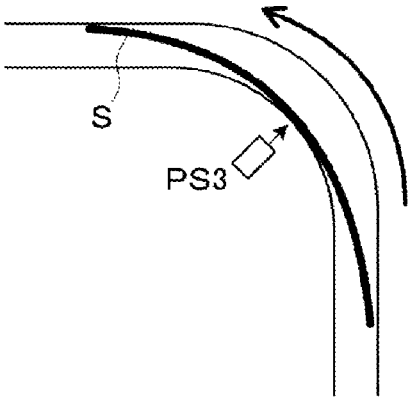
Figure 3C:
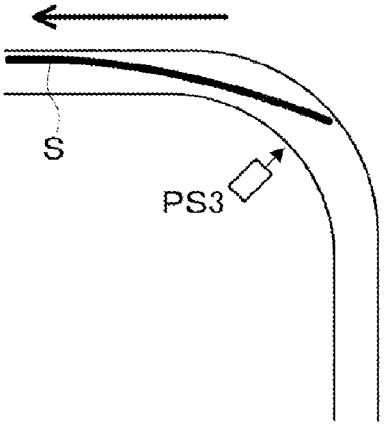

FIGS. 3A to 3C are diagrams illustrating states where the sheet S passes through a curved part of the conveyance passage P4. The photosensor PS3 is disposed in the curved part of the conveyance passage P4. FIG. 3A illustrates a state where the leading end of the sheet S approaches the curved part of the conveyance passage P4. At this time, the sheet S is conveyed in a state where the sheet S is inclined with respect to the irradiation direction of the photosensor PS3. Therefore, in this case, the sheet S is not vertically irradiated with the irradiation light from the photosensor PS3, but is irradiated with the irradiation light in an inclination direction.

FIG. 3B illustrates a state where the sheet S passes through the curved part of the conveyance passage P4. At this time, the sheet S is vertically irradiated with the irradiation light from the photosensor PS3. FIG. 3C illustrates a state where the rear end of the sheet S passes through the curved part of the conveyance passage P4. Therefore, in this case, the sheet S is not vertically irradiated with the irradiation light from the photosensor PS3, but is irradiated with the irradiation light in an inclination direction.

Figure 4A:
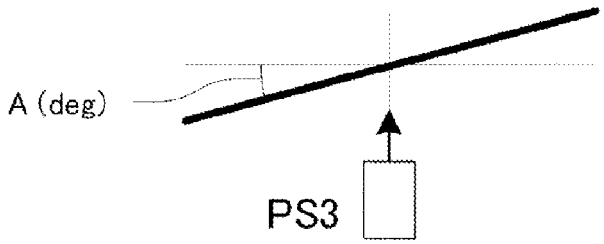
FIG. 4A is a diagram illustrating an angle of an inclination of a sheet with respect to an irradiation direction when the sheet passes through the curved sheet conveyance path.
Figure 4B:
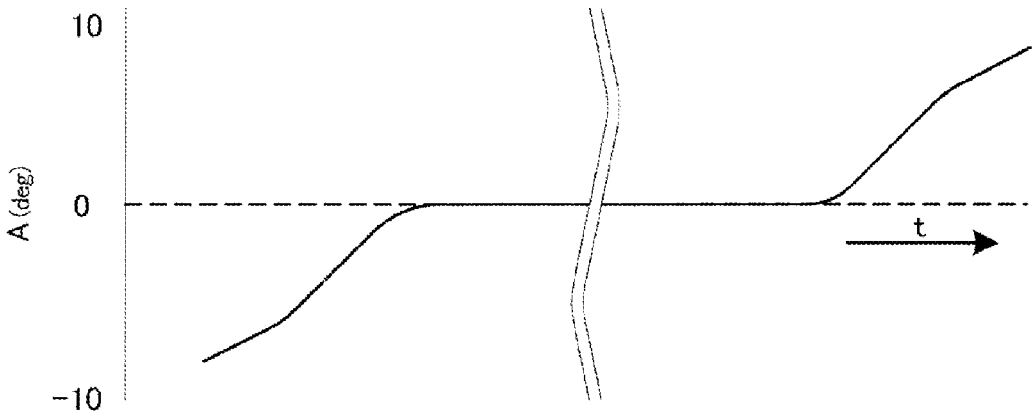
FIG. 4B is a graph illustrating the angle of the inclination of the sheet.

Here, on the assumption that A (degree) is an angle of the inclination of the sheet S with respect to the irradiation light with which the sheet is vertically irradiated from the photosensor PS3, as illustrated in FIG. 4A, the angle A is sequentially changed when the sheet S passes through the curved part of the conveyance passage P4, as illustrated in FIGS. 3A to 3C. For example, as illustrated in FIG. 4B, the angle A is about −10 degrees in the early stage of the approach of the sheet S to the conveyance passage P4.

However, as the sheet S is gradually conveyed, the angle A becomes almost zero. When the sheet S is further conveyed, the angle A becomes about +10 degrees and is reversed, compared to the early state of the approach.

Figure 5A:
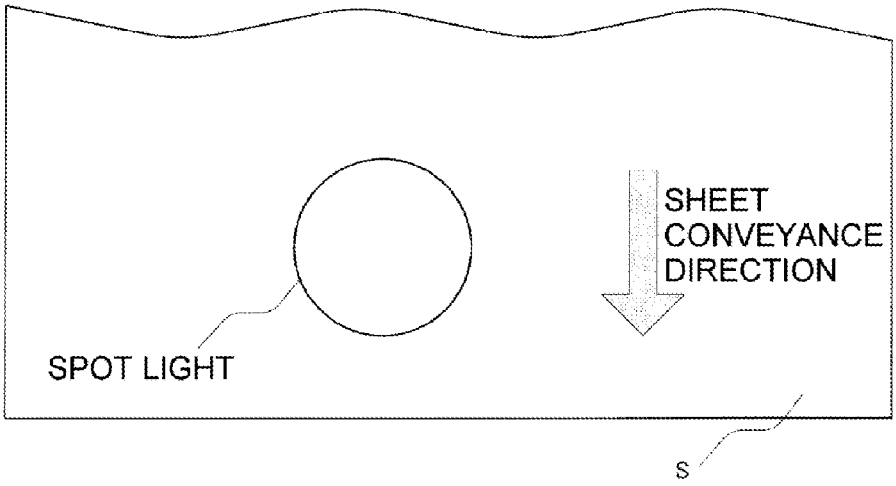
FIGS. 5A and 5B are diagrams illustrating a spot shape of the irradiation light from the photosensor.

When the light-emitting lens 22 is circular, as in the photosensor PS illustrated in FIGS. 2A and 2B, the spot light of the emitted light from the light-emitting portion 21 is almost circular, as illustrated in FIG. 5A. However, when the spot light is circular and the sheet S is conveyed in the inclined state with respect to the irradiation direction of the photosensor PS, as illustrated in FIG. 2B, the light reflected from the sheet S is not returned in the direction of the light-receiving lens 33 of the photosensor PS as the angle A increases. In this case, particularly, when the sheet S is a sheet with a high reflection ratio, the irregular reflection component is small and the sheet is rarely detected, and thus the photosensor PS may not receive the reflected light.

Figure 5B:
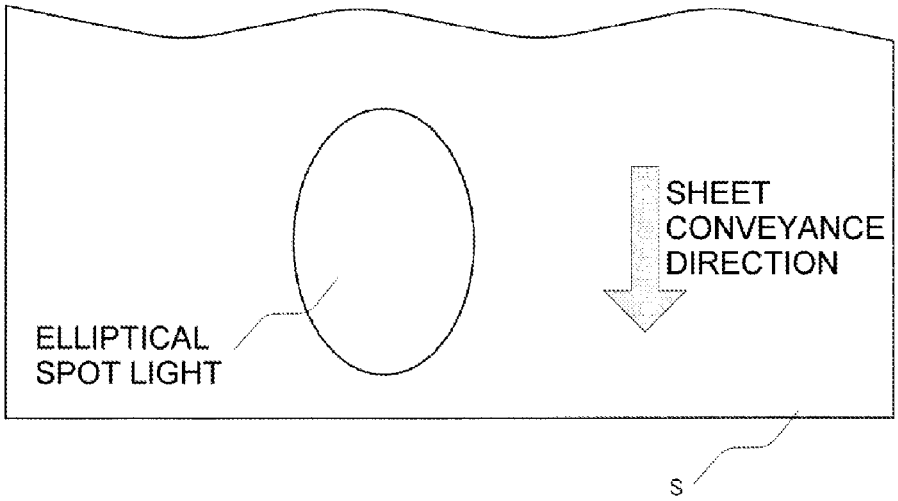
Figure 6A:
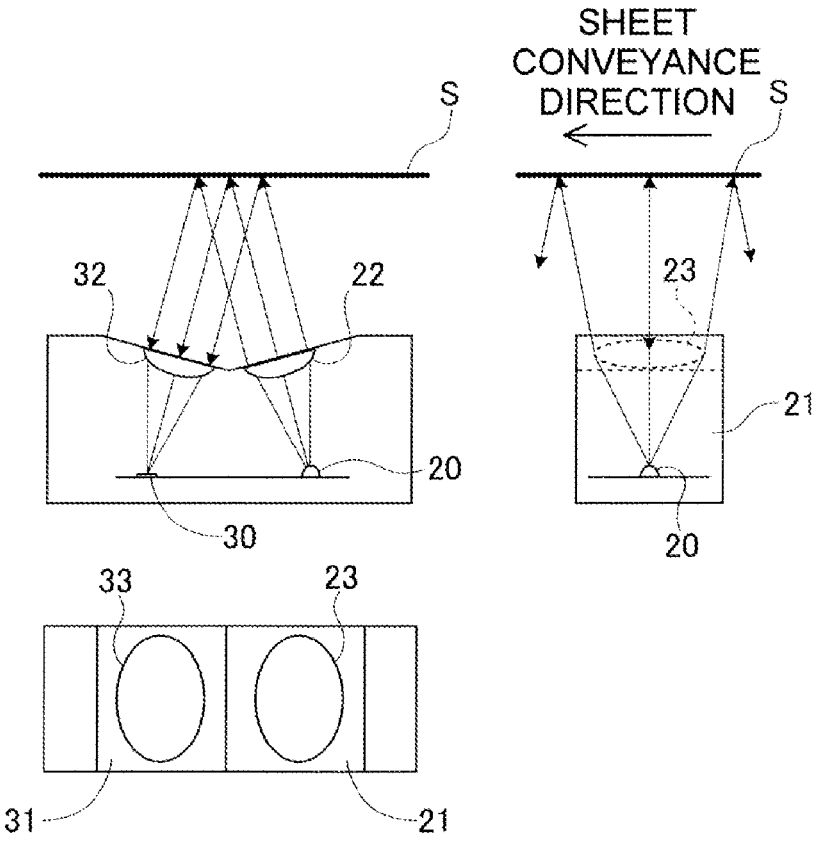
FIGS. 6A and 6B are diagrams illustrating the configuration of the photosensor disposed in the curved sheet conveyance path.
Figure 6B:
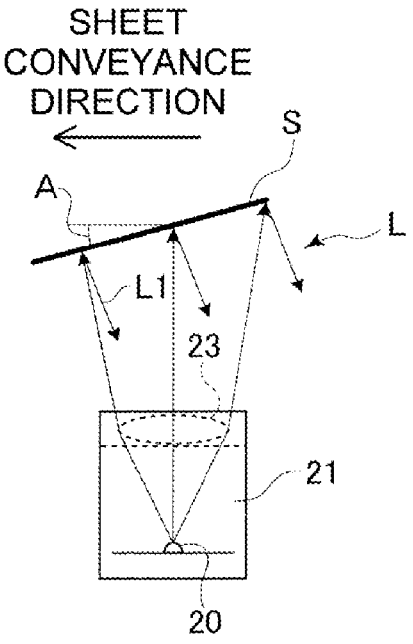

Accordingly, in this embodiment, as illustrated in FIGS. 6A and 6B, a photosensor, which includes an elliptical light-emitting lens 23 as the light-emitting lens and an elliptical light-receiving lens 33 as the light-receiving lens, is disposed in the curved part of the conveyance passage P4 in which at least the angle A increases. Here, when the light-emitting lens 23 is elliptical, the spot light of the irradiation light from the light-emitting portion 21 becomes elliptical, as illustrated in FIG. 5B.

Figure 7:
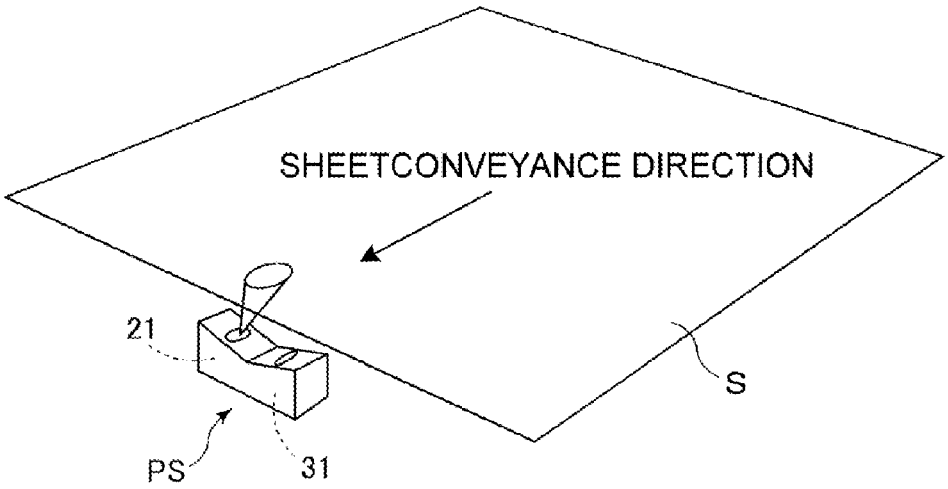
FIG. 7 is a diagram illustrating the position of the photosensor disposed in the curved sheet conveyance path.

In this embodiment, as illustrated in FIGS. 5B and 7, the light-emitting lens 23 and the light-receiving lens 33 of the photosensor PS are disposed so that the major sides are parallel to each other in the sheet conveyance direction. When the elliptical light-emitting lens 23 is used, as illustrated in FIG. 6B, the irradiation light is expanded in the sheet conveyance direction. Therefore, even when the sheet S is inclined, partial reflected light L1 of the reflected light L that is reflected from the sheet S is returned to the light-receiving lens.

Accordingly, even when the sheet S with a high reflection ratio is conveyed in an inclined state, the sheet S can be reliably detected. At this time, since the light-receiving lens 33 is also elliptical, the reflected light can be reliably received. In this way, by configuring the light-emitting lens 23 as an elliptical lens, the photosensor PS can receive the reflected light even when the sheet S is conveyed in the sheet conveyance direction in the inclined state.

In this embodiment, as described above, the sheet can be irradiated with the light from the light-emitting portion 21 by the use of the elliptical light-emitting lens 23 so that the light is vertically long in the sheet conveyance direction, in other words, the sheet is irradiated with the light expanded in the sheet conveyance direction. Accordingly, since the sheet can be irradiated with the light from the light-emitting portion 21 in a range that is broad in the sheet conveyance direction, the sheet such as an OHP in which the irregular reflection is small can be reliably detected even when the sheet is inclined by an angle. That is, by irradiating the sheet S with the light from the light-emitting portion 21 so that the light is expanded in the sheet conveyance direction and by orienting the light reflected from the sheet S toward the light-receiving portion, it is possible to reliably detect the sheet being conveyed at high speed along the curved sheet conveyance path.

In this case, the irradiation light can be expanded only in a necessary direction, that is, in the sheet conveyance direction. Therefore, for example, even when an escape hole is formed in the guide member forming the conveyance passage P4, it is unnecessary to form a large escape hole. Accordingly, even when the sheet is conveyed at high speed along the sheet conveyance path, the sheet can be prevented from being jammed.

For example, as illustrated in FIG. 2B, the sheet is easily inclined in the sheet conveyance direction in the curved part of the sheet conveyance path, but the sheet is not inclined in a width direction perpendicular to the sheet conveyance direction. Therefore, it is not necessary to expand the light in the width direction. On the contrary, when the light is expanded in the width direction, erroneous detection may increase due to unnecessary reflection from the guide member or the like forming the conveyance passage P4. The light-emitting portion 21 irradiates the passing sheet in an irradiating range that is broader in the sheet conveyance direction than the width direction perpendicular to the sheet conveyance direction. Accordingly, in this embodiment, by disposing the elliptical light-emitting lens 23 in the sheet conveyance direction and expanding the irradiation light in the sheet conveyance direction, it is possible to reliably detect a sheet with a high reflection ratio without erroneous detection.

Figure 8A:
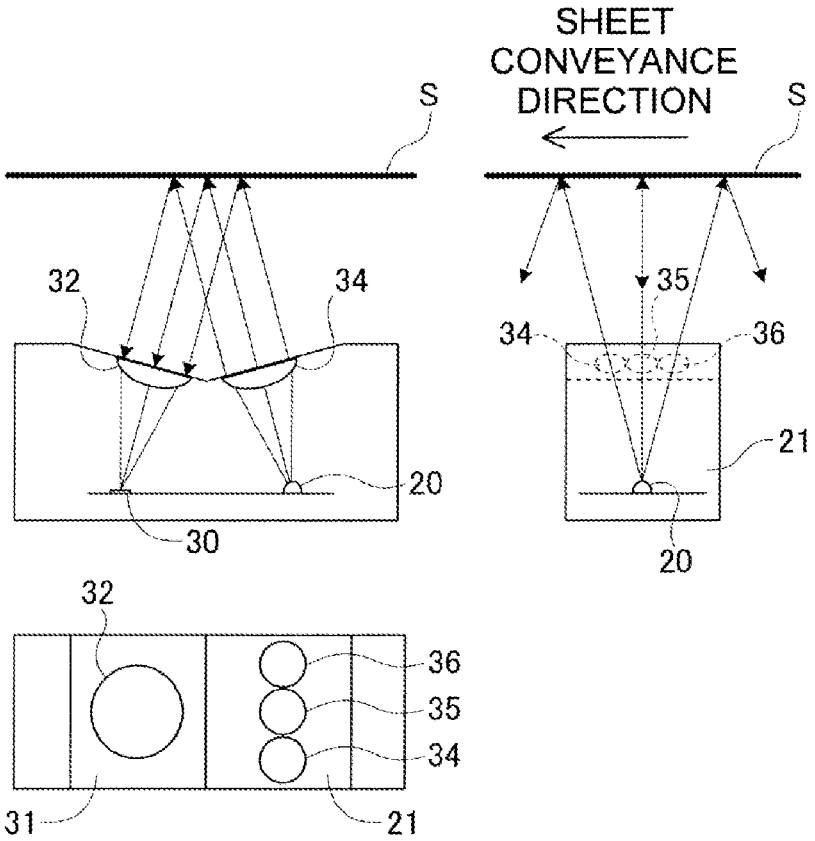
FIGS. 8A and 8B are diagrams illustrating the configuration of a photosensor used in a sheet conveying apparatus according to a second embodiment of the invention.
Figure 8B:
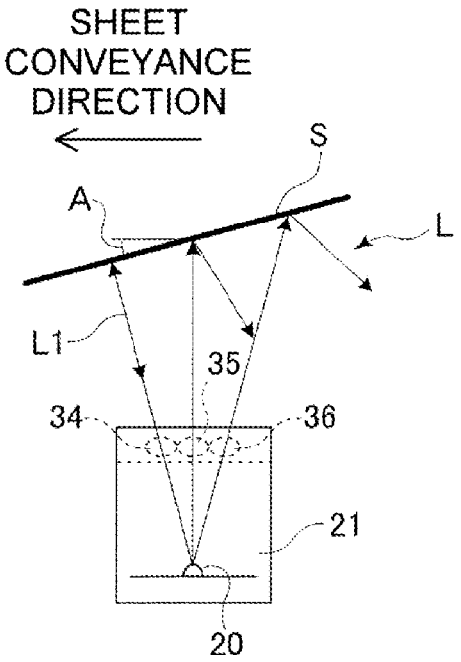

Next, a second embodiment of the invention will be described. FIGS. 8A and 8B are diagrams illustrating the configuration of a photosensor used in a sheet conveyance apparatus according to this embodiment. In FIGS. 8A and 8B, the same reference numerals in FIGS. 2A and 2B are given to the same constituent elements or corresponding elements.

FIGS. 8A and 8B illustrate circular light-emitting lenses 34 to 36. The three (plurality of) light-emitting lenses 34 to 36 are disposed in the sheet conveyance direction. That is, in this embodiment, the three light-emitting lenses 34 to 36 of the light-emitting portion 21 are arranged in the sheet conveyance direction. With such a configuration, as illustrated in FIG. 8A, the irradiation light from the LED 20 serving as a light-emitting source forms three different optical axes in the sheet conveyance direction by the three light-emitting lenses 34 to 36 arranged in the sheet conveyance direction. Accordingly, the sheet can be irradiated with the light from the light-emitting portion 21 so that the light is vertically long in the sheet conveyance direction, in other words, the sheet is irradiated with the light expanded in the sheet conveyance direction.

As a result, even when the sheet S is inclined by the angle A, as illustrated in FIG. 8B, partial reflected light L1 of the reflected light L reflected from the sheet S is returned to the light-receiving lens. Accordingly, even when the sheet S with a high reflection ratio is conveyed in an inclined state, the sheet S can be reliably detected. In this embodiment, three light-emitting lenses 34 to 36 are arranged. However, when two or more light-emitting lenses are present, a plurality of different optical axes can be formed, thereby obtaining the same advantages.

Figure 9A:
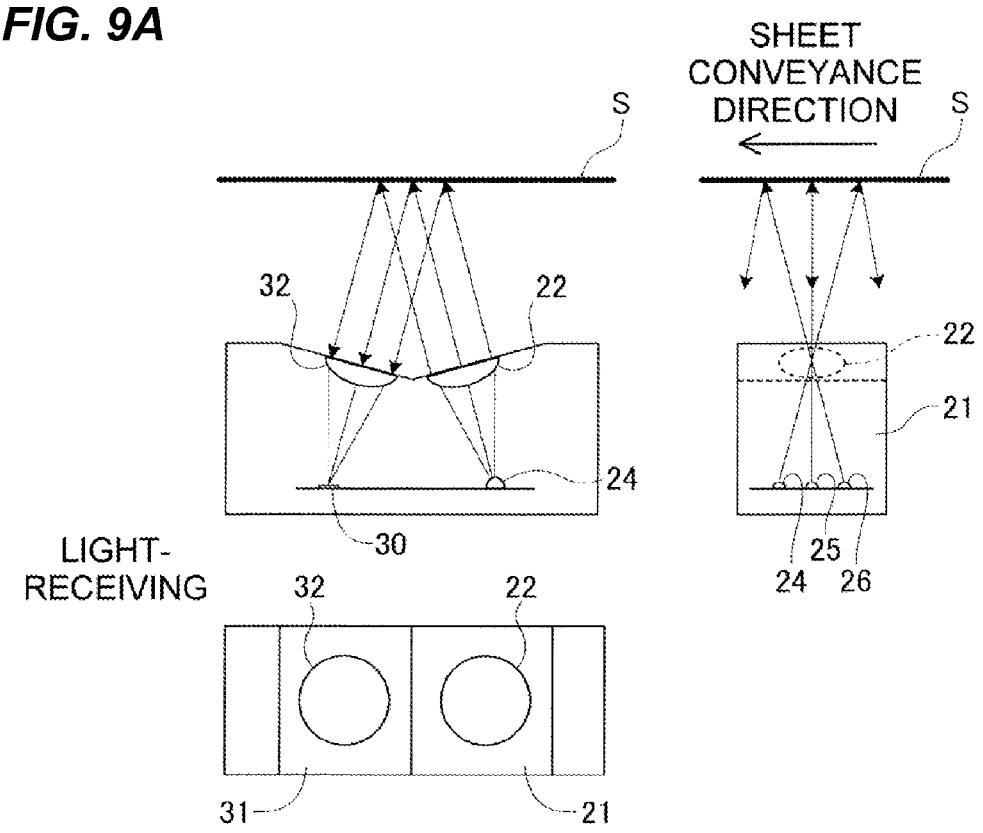
FIGS. 9A and 9B are diagrams illustrating the configuration of a photosensor used in a sheet conveying apparatus according to a third embodiment of the invention.
Figure 9B:
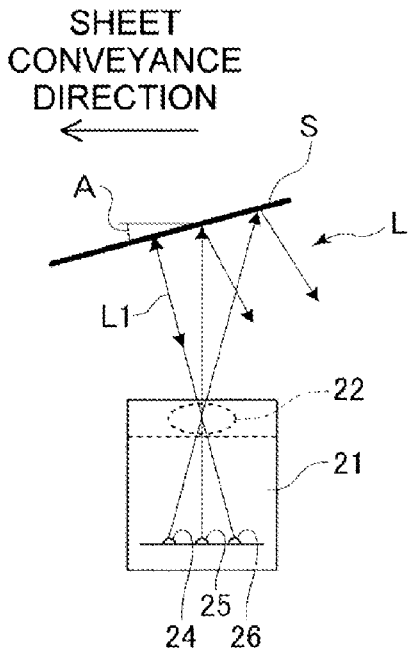

Next, a third embodiment of the invention will be described. FIGS. 9A and 9B are diagrams illustrating the configuration of a photosensor used in a sheet conveyance apparatus according to this embodiment. In FIGS. 9A and 9B, the same reference numerals in FIGS. 2A and 2B are given to the same constituent elements or corresponding elements.

FIGS. 9A and 9B illustrate LEDs 24 to 26 serving as light-emitting sources. The three (plurality of) LEDs 24 to 26 are arranged in the sheet conveyance direction. That is, in this embodiment, the three LEDs 24 to 26 are arranged in the sheet conveyance direction. With such a configuration, as illustrated in FIG. 9A, the LEDs 24 to 26 form different angles with respect to the light-emitting lens 22. Three different optical axes of different directions are formed in the sheet conveyance direction.

As a result, even when the sheet S is inclined by the angle A, as illustrated in FIG. 9B, partial reflected light L1 of the reflected light L reflected from the sheet S is returned to the light-receiving lens. Accordingly, even when the sheet S with a high reflection ratio is conveyed in an inclined state, the sheet S can be reliably detected. In this embodiment, three LEDs 24 to 26 serving as the light sources are arranged. However, when two or more light sources are present, a plurality of different optical axes can be formed, thereby obtaining the same advantages.

The sheet conveyance apparatus installed in the image forming apparatus has hitherto been described, but the invention is not limited thereto. The invention is applicable to a sheet conveying apparatus installed in an image reading apparatus including an image reading portion.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-095658, filed Apr. 22, 2011, which is hereby incorporated by reference herein in its entirety.

What is claimed is:

1. A sheet conveying apparatus comprising:

a sheet conveyance path through which a sheet conveyed in a sheet conveyance direction passes, the sheet conveyance path having a curved section in which the sheet is curved as it passes through the curved section so that the sheet changes its distance to an inner curved portion within the sheet conveyance path as the sheet is conveyed in the sheet conveyance direction; and a detection unit which detects a curved sheet in the curved section of the sheet conveyance path, wherein the detection unit comprises:

a light-emitting surface from which light directed toward the sheet conveyance path emits, and a light-receiving surface which receives reflected light that has been reflected from the sheet in the sheet conveyance path, and wherein the detection unit is configured so that, the light-emitting surface and the light-receiving surface are arranged in a width direction of the sheet perpendicular to the sheet conveyance direction, and the reflected light received by the light-receiving surface has a length in the sheet conveyance direction which is longer than a length in a direction perpendicular to the sheet conveyance direction and perpendicular to an advancing direction in which the reflected light advances toward the light receiving surface.

2. The sheet conveying apparatus according to claim 1, wherein the detection unit further comprises:

a light source; and a lens provided with the light-emitting surface and disposed between the light source and the sheet conveyance path at a position where light from the light source to the sheet conveyance path passes through the lens, wherein the lens is elliptical with a length in the sheet conveyance direction longer than a length orthogonal thereto.

3. The sheet conveying apparatus according to claim 1, wherein the detection unit further comprises;

a light-receiving element; and a lens provided with the light-receiving surface and disposed between the sheet conveyance path and the light-receiving element, the lens configured to collect the reflected light from the sheet.

4. The sheet conveying apparatus according to claim 3, wherein the lens is elliptical with a length in the sheet conveyance direction longer than a length orthogonal thereto.

5. The sheet conveying apparatus, according to claim 1, wherein the detection unit is configured to irradiate the light toward a surface of the sheet orthogonally in a direction perpendicular to the sheet conveyance direction.

6. The sheet conveying apparatus, according to claim 1, wherein light emitted from the light-emitting surface having a length on a cross-sectional plane perpendicular to an optic axis of the light in the sheet conveyance direction that is longer than a length on a cross-sectional plane perpendicular to the optic axis of the light and perpendicular to the sheet conveyance direction.

7. An image forming apparatus comprising:

an image forming portion that forms an image on a sheet;

a sheet conveyance path through which a sheet conveyed in a sheet conveyance direction passes, the sheet conveyance path having a curved section in which the sheet is curved as it passes through the curved section so that the sheet changes its distance to an inner curved portion within the sheet conveyance path as the sheet is conveyed in the sheet conveyance direction; and a detection unit which detects a curved sheet in the curved section of the sheet conveyance path, wherein the detection unit comprises:

a light-emitting surface from which light directed toward the curved section of the sheet conveyance path emits and a light-receiving surface which receives reflected light that has been reflected from the curved sheet in the curved section of the sheet conveyance path, wherein the detection unit is configured so that, the light-emitting surface and the light-receiving surface are aligned in a width direction of the sheet perpendicular to the sheet conveyance direction, and the reflected light received by the light-receiving surface has a length in the sheet conveyance direction which is longer than a length in a direction perpendicular to the sheet conveyance direction and perpendicular to a advancing direction in which the reflected light advances toward the light receiving surface.

8. The image forming apparatus according to claim 7, wherein the detection unit further comprises:

a light source; and a lens disposed between the light source and the curved section of the sheet conveyance path, light from the light source to the sheet conveyance path passing through the lens, and wherein the lens is elliptical with a length in the sheet conveyance direction longer than a length orthogonal thereto.

9. The image forming apparatus according to claim 7, wherein the detection unit further comprises;

a light receiving element; and a lens disposed between the curved section of the sheet conveyance path and the light-receiving element, the lens collecting the reflected light from the sheet.

10. A sheet conveying apparatus comprising:

a sheet conveyance path through which a sheet conveyed in a sheet conveyance direction passes, the sheet conveyance path having a curved section in which the sheet is curved as it passes through the curved section so that the sheet changes its distance to an inner curved portion within the sheet conveyance path as the sheet is conveyed in the sheet conveyance direction; and a sensor that is disposed in the sheet conveyance path and which detects a curved sheet in the curved section of the sheet conveyance path, wherein the sensor has a light-emitting portion that emits light to the sheet and a light-receiving portion that receives light reflected from the sheet, and wherein the light-emitting portion has a light source and a lens for collecting light from the light source and for irradiating a light expanding in the sheet conveyance direction and a cross-sectional shape of the lens in a plane perpendicular to an advancing direction in which the light advances to the sheet conveyance path is an elliptical shape having a length in the sheet conveyance direction larger than a length orthogonal thereof.

11. The sheet conveying apparatus according to claim 10, wherein the sheet conveyance path has the curved section and the sensor is disposed at the curved section of the sheet conveyance path and the light-emitting portion irradiates the sheet passing through the curved section.

12. The sheet conveying apparatus, according to claim 10, wherein the light-emitting portion and the light-receiving portion are arranged in a sheet width direction perpendicular to the sheet conveyance direction, and wherein the sensor irradiates the light toward a surface of the sheet orthogonally in a direction perpendicular to the sheet conveyance direction.

13. A sheet conveying apparatus comprising:

a sheet conveyance path through which a sheet conveyed in a sheet conveyance direction passes, the sheet conveyance path having a curved section in which the sheet is curved as it passes through the curved section so that the sheet changes its distance to an inner curved portion within the sheet conveyance path as the sheet is conveyed in the sheet conveyance direction; and a sensor that is disposed in the sheet conveyance path and detects a curved sheet in the curved section of the sheet conveyance path, wherein the sensor comprises:

a light-emitting portion that has a light source and a lens for collecting light from the light source and for irradiating the sheet in the sheet conveyance path, and a cross-sectional shape of the lens in a plane perpendicular to an optic axis of the light from the light source is an elliptical shape having a length in the sheet conveyance direction larger than a length orthogonal thereof and a light emitted from the lens having a length on a cross-sectional plane perpendicular to the optic axis of the light in the sheet conveyance direction is longer than a length on a cross-sectional plane perpendicular to the optic axis of the light and perpendicular to the sheet conveyance direction, and a light-receiving portion that receives light reflected from the sheet.

14. The sheet conveying apparatus, according to claim 13, wherein the sensor further comprises:

a light-receiving element; and a lens which is elliptical with a length in the sheet conveyance direction larger than a length orthogonal thereto and disposed between the sheet conveyance path and the light-receiving element, the lens collecting the reflected light from the sheet.

15. A sheet conveying apparatus, comprising:

a sheet conveyance path having at least one curved section through which a sheet conveyed in a sheet conveyance direction passes, the curved section such that the sheet is curved as it passes through the curved section so that the sheet changes its distance to an inner curved portion within the sheet conveyance path as the sheet is conveyed in the sheet conveyance direction; and a detection unit which detects the curved sheet in the curved section of the sheet conveyance path, wherein the detection unit comprises:

a light source, a first lens disposed between the light source and the sheet conveyance path at a position where light from the light source to the sheet conveyance path passes through the first lens, a light-receiving element that receives reflected light that has been reflected from the sheet in the sheet conveyance path; and a second lens disposed between the sheet conveyance path and the light-receiving element at a position where reflected light from the sheet to the light-receiving element passes through the second lens, wherein the first lens and the second lens are arranged in a width direction of the sheet perpendicular to the sheet conveyance direction so that a principal axis of the first lens does not intersect the second lens, and wherein the second lens has a cross-sectional shape in a plane perpendicular to an advancing direction of the reflected light toward the light-receiving element has a length in the sheet conveyance direction larger than a length orthogonal thereof.

16. The sheet conveying apparatus, according to claim 15, wherein the cross-sectional shape of the second lens in the plane perpendicular to the advancing direction of the reflected light is an elliptical shape having a length in the sheet conveyance direction larger than a length orthogonal thereof.

17. The sheet conveying apparatus, according to claim 15, wherein the first lens is disposed between the light source and the sheet conveyance path such that light emitted from the light source to the sheet conveyance path passes through the first lens, a length of the first lens in the sheet conveyance direction being longer than a length of the first lens in a width direction which is perpendicular to the sheet conveyance direction.

18. The sheet conveying apparatus, according to claim 15, wherein the first lens being elliptical with a length in the sheet conveyance direction larger than a length orthogonal thereto.

19. The sheet conveying apparatus, according to claim 15, wherein the first lens includes a plurality of lenses disposed between the light source and the sheet conveyance path, wherein light emitted from the light source to the sheet conveyance path passes through the plurality of lenses.

20. The sheet conveying apparatus, according to claim 15, wherein the detection unit is configured to irradiate the light toward a surface of the sheet orthogonally in a direction perpendicular to the sheet conveyance direction.

21. The sheet conveying apparatus, according to claim 15, wherein the first lens is elliptical with a length in the sheet conveyance direction larger than a length orthogonal thereto.

22. The sheet conveying apparatus, according to claim 15, wherein the second lens is elliptical with a length in the sheet conveyance direction larger than a length orthogonal thereto and disposed between the sheet conveyance path and the light-receiving element, the second lens collecting the reflected light from the sheet.

* * * * *